US005528835A

United States Patent [19]

Ra

[11] Patent Number: 5,528,835

[45] Date of Patent: Jun. 25, 1996

[54] CHAIN SAW TENSIONING APPARATUS

[76] Inventor: Do-Jin Ra, 65-84 Booth St., Apt. 1L, Rego Park, N.Y. 11374

[21] Appl. No.: 346,518

[22] Filed: Nov. 29, 1994

[51] Int. Cl.[6] ..... B27B 17/14

[52] U.S. Cl. ..... 30/386; 30/383

[58] Field of Search ..... 30/381, 382, 383, 30/384, 386, 385

[56] References Cited

U.S. PATENT DOCUMENTS

| | | | |
|---|---|---|---|
| 830,860 | 9/1906 | Smith . | |
| 2,296,240 | 9/1942 | Blum | 30/385 |
| 2,645,254 | 7/1953 | Van Ausdall | 30/386 |
| 2,765,821 | 10/1956 | Strunk . | |
| 2,767,746 | 10/1956 | Adams . | |
| 2,910,099 | 10/1959 | Mall . | |
| 3,194,284 | 7/1965 | Walker . | |
| 3,866,320 | 2/1975 | Progl | 30/386 |
| 4,223,438 | 9/1980 | Kerrison | 30/123 |
| 4,315,370 | 2/1982 | Horne | 30/386 |
| 4,316,327 | 8/1982 | Scott et al. | 30/386 |
| 4,563,817 | 1/1986 | Leighton | 30/386 |
| 4,835,868 | 6/1989 | Nagashima | 30/386 |
| 4,920,650 | 5/1990 | Edlund | 30/386 |
| 4,999,918 | 3/1991 | Schliemann | 30/386 |
| 5,070,618 | 12/1991 | Edlund | 30/386 |
| 5,144,751 | 9/1992 | Weber | 30/386 |
| 5,174,029 | 12/1992 | Talberg | 30/386 |
| 5,177,871 | 1/1993 | Martenson | 30/122 |
| 5,345,686 | 9/1994 | Zimmermann | 30/386 |

*Primary Examiner*—Hwei-Siu Payer
*Attorney, Agent, or Firm*—Weingram & Zall

[57] ABSTRACT

The chain saw tensioner of the present invention provides a sheath anchored at one end to the housing of the chain saw which sheath receives a tensioning shaft slidably therein. The tensioning shaft is interconnected with the housing by a tension screw and is slidably adjustable with respect to the sheath by actuating the tensioning screw. The tensioning shaft and the sheath have matching and aligned slots that cooperate to receive a sliding bolt therethrough. The sliding bolt is interconnected with the blade of the saw and, by actuating the tensioning screw, it may be moved forward with respect to the housing of the saw to move the saw blade forward to tension the chain. Included within the tensioning shaft is a spring interconnected with a bolt rest for receiving and supporting the sliding bolt. The spring provides a bias which acts on the bolt to bias the bolt, and accordingly the saw blade, forward with respect to the housing to tension the chain. The spring further allows the bolt to move rearward of the tensioning shaft, and accordingly, rearward of the housing to decrease tension on the chain to prevent over tensioning of the chain.

12 Claims, 2 Drawing Sheets

CHAIN SAW TENSIONING APPARATUS

BACKGROUND OF THE INVENTION

1. Field of the Invention

This invention generally relates to a method and apparatus for tensioning a chain saw and more particularly to a method and apparatus for quickly and easily increasing the tension on the chain of a chain saw to maintain proper tension on the chain.

2. Description of the Prior Art

In the operation of a chain saw the chain extends around the drive shaft and the chain saw blade. It is necessary for the chain to be properly tensioned. If the tension on the chain is either in excess or insufficient, the life of the chain can be greatly shortened. Additionally, excess or insufficient tension can result in problems associated with broken chains and/or disattachment of the chain from the saw, both of which can potentially seriously injure an operator of a chain saw.

During use of the chain saw, the chain tension changes because the link pivots wear, and, accordingly, the chain tends to lengthen over its life. Thus, it is important for a chain saw to include means to quickly, easily and properly apply tension to the chain. Past efforts in this area have provided cumbersome devices that are unable to accurately tension the chain without overtensioning the chain. These efforts are outlined in the following patents:

Smith, U.S. Pat. No. 830,860 discloses a chain saw having a frame comprising two flat mating solid sides and a track having straight edges and inwardly-curved ends fixed therebetween to form a chamber for storing oil for lubricating the track. A rotatable shaft is mounted to the frame on adjustable bearings and supported by brackets attached to the frame by set screws for adjusting the shaft relative to the frame and saw for regulating the tension of the saw on the track.

Strunk, U.S. Pat. No. 2,765,821 discloses a chain saw blade tensioning device rigidly adjustably securing the saw blade to the frame. The frame is provided with a pair of bosses which support a pair of studs in a mutually spaced relation. The studs may receive nuts which, when tightened, rigidly adjustably secure the saw blade in fixed relation to the frame. The saw blade may be adjusted relative to the chain sprocket to tension the chain by means of a take-up device which includes a shiftable rigid plate having an elongated slot. The plate member includes an adjusting screw for shifting of plate with respect to the frame. Tensioning of the saw is accomplished by loosening nuts on the studs, then turning the adjusting screw to shift the saw blade outwardly in the frame.

Adams, U.S. Pat. No. 2,767,746 discloses a chain tightener for a powered chain saw comprising a bolt having one end interconnected with the chain saw cutting bar and the other end extending into the frame member. A nut is positioned on the bolt. When the nut is tightened, the bar is shifted outwardly with respect to frame to tighten the chain.

Mall, U.S. Pat. No. 2,910,099 discloses an auxiliary take-up handle for a chain saw having an idler roller. The device includes an adjustment means to lengthen or shorten the guide bar for adjusting the tension of the saw chain. In order to tension the chain, the handle is turned to thread adjusting member along the shaft position of the handle to move the idler assembly away from the guide bar to tension the chain. Also provided within the handle is a coil spring for preventing over tensioning of the chain and for acting as a shock absorber and accepting abnormal loads.

Walker, U.S. Pat. No. 2,194,284 discloses a tension adjusting means for tensioning a chain saw comprising a cutting bar attached to a frame by means of a pair of spaced studs. The cutting bar includes on the elongated slot through which the studs extend. The frame includes a slot member having a ribbed portion which receives a screw and a nut having a projecting lug. A coil spring is positioned between the nut and the lug. The lug bears against an aperture in the bar to urge the bar towards its distal end.

Progl, U.S. Pat. No. 3,866,320 discloses a chain saw with a convenient means for adjusting the tightness of the chain on the guide bar comprising an adjusting screw for moving the guide bar of a chain saw away from the frame to tension the chain. The adjusting screw is rotatable by a member that extends outside of the cover which may be easily accessed by an operator. The rotatable member is connected to the adjusting screw by an angle drive means.

Kerrison, U.S. Pat. No. 4,223,438 discloses a direct bar oiler for chain saws. The device includes a bolt with a traveling block positioned thereabout. The bolt extends through a groove that receives the traveling block. Rotation of the bolt moves the traveling block along the groove. The traveling block has a finger which engages the aperture in the chain bar for moving the chain bar with respect to the frame to tension the chain.

Nagashima, U.S. Pat. No. 4,835,868 discloses a chain saw tensioner having a threaded rod member received in a hole of the frame and a pin member screwed onto the threaded rod member. A portion of the rod member extends through a lateral guide slot and into a slot formed in the chain guide bar whereby when the threaded rod member is rotated, the pin member moves in the axial direction of the threaded rod member to move the chain guide bar with respect to the frame tension the saw chain.

Scott et al., U.S. Pat. No. 4,316,327 discloses a chain saw with a tension adjustment screw engaging the rearward end of the saw bar mounted on the frame of the saw, at the rear thereof, for accessibility.

Schliemann et al., U.S. Pat. No. 4,999,918 discloses a chain saw with a chain tensioning device for adjusting the tensioning force of the chain. The guide bar is clamped to the housing at one end thereof. For tensioning the chain, the guide bar is movable along a longitudinal direction when the clamping piece is loosened.

Martenson, U.S. Pat. No. 5,177,871 discloses a belt tension system for power tool comprising a frame, an arm, a means for affixing the arm to the frame, and a means for moving the arm relative to the frame. Means for adjusting tension includes a driven gear, a drive gear perpendicular to the driven gear, a visual tension indicator connected to the driven gear, and a spring. The drive gear has helical threads adapted to engage the threads on the driven gear in order to tension the belt. A bolt that attaches the arm to the frame is loosened and the spring biases the arm forward to further adjust the tension. A screwdriver is used to rotate the drive gear which coacts with the driven gear to rotate a threaded shaft to increase the tension.

Edlund, U.S. Pat. No. 5,070,618 discloses a guide bar for a chain wherein the guidebar is moveable with respect to the body of the chain saw, thereby moving the blade of the chain saw with respect to the body to tension the chain comprising a cog wheel interconnected with the shaft extending through a fitting hole in the guidebar. Also included is a cup spring on the shaft between the cog wheel and a plate for preventing self turning of the shaft. Also included are two guide bar bolts with nuts. The tightening of the nuts compresses the cup spring to lock the cog wheel in its set position.

Horne, U.S. Pat. No. 4,315,370 discloses a chain saw with a chain bar having a chain and a lever for moving the chain bar to tension the chain and a bolt for fastening the cutter bar in a desired position.

Leighton, U.S. Pat. No. 4,563,817, discloses a chain saw bar having a base end with an elongated slot including a ratchet end crawl structure carried at the base end of the bar. The ratchet and crawl structure enables lengthwise adjustment of the bar. The ratchet and crawl structure includes ratchet teeth and a clamp plate facing the ratchet teeth including resilient crawl members for engagement with the ratchet teeth.

Edlund, U.S. Pat. No. 4,920,650, discloses a tension arrangement for a chain saw in which the chain saw sword is secured to the saw body with a bolt and is displaceable along its longitudinal axis by means of a tension screw.

Talberg, U.S. Pat. No. 5,174,029, the chain saw includes a distal portion of a blade that is slidable with respect to the base portions. The means are provided for extending the distal portion of the cutting bore relative to the base portion.

None of these prior efforts, taken either alone or in combination, teach or suggest all of the elements or the advantages of the present invention. Particularly, none of these patents teach a way to quickly, easily and accurately tension a chain for a chain saw, without overtensioning the chain.

OBJECTS AND SUMMARY OF THE INVENTION

It is an object of the present invention to provide an apparatus for tensioning a chain saw.

It is another object of the present invention to provide an apparatus for tensioning a chain saw that may be easily actuated.

It is even another object of the present invention to provide an apparatus to tension a chain saw that can accurately adjust the tension of a chain saw.

It is even another object of the present invention to provide an apparatus to tension a chain saw which provides means for preventing overtensioning of the chain.

It is another object of the present invention to provide a simple method for tensioning a chain saw.

It is even another object of the present invention to provide a method for tensioning a chain saw which can accurately adjust the tension of a chain saw.

It is even another object of the present invention to provide a method for tensioning a chain saw which prevents overtensioning of the chain.

It is still another object of the present invention to provide an apparatus for tensioning a chain saw which includes a spring to prevent overtensioning of the chain.

The chain saw tensioner of the present invention achieves these objects by means of a sheath anchored at one end to the housing of the chain saw which sheath receives a tensioning shaft slidably therein. The tensioning shaft is interconnected with the housing by a tension screw and is slidably adjustable with respect to the sheath by actuating the tensioning screw. The tensioning shaft and the sheath have matching and aligned slots that cooperate to receive a sliding bolt therethrough. The sliding bolt is interconnected with the blade of the saw and, by actuating the tensioning screw, it may moved forward with respect to the housing of the saw to move the saw blade-forward to tension the chain. Included within the tensioning shaft is a spring interconnected with a bolt rest for receiving and supporting the sliding bolt. The spring provides a bias which acts on the bolt, to bias the bolt and accordingly the saw blade forward with respect to the housing to tension the chain. The spring further allows the bolt to move rearward of the tensioning shaft, and accordingly, rearward of the housing to decrease tension on the chain to prevent overtensioning of the chain.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

Figure 1:
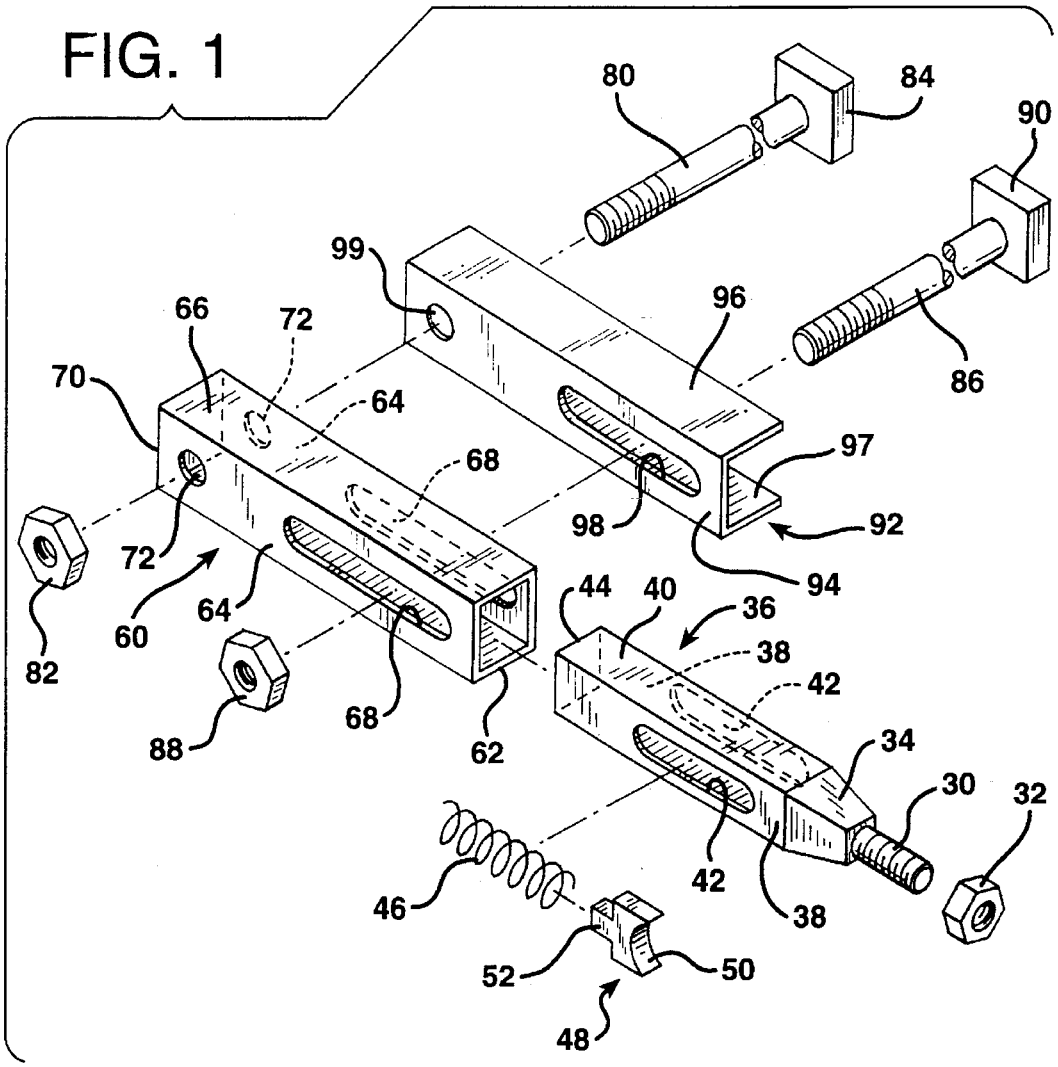
FIG. 1 is an exploded view of the chain saw tensioning apparatus of the present invention.

As shown in FIGS. 1—4, the present invention relates to a tensioner for a chain of a chain saw. The chain saw, generally indicated at 10, includes a housing 12 having a motor 14 mounted therein. The tensioner of the present invention is interconnected with the housing by tensioner mounts 16. The tensioner of the present invention is positioned between the tensioner mounts 16 and the blade 20 of chain saw 10. The blade 20 includes a blade slot 22 for receiving bolts extending from the tensioner for attaching the blade 20 to the chain saw 10. The blade 20 carries a chain 24 about the blade. The chain 24 also extends about drive gear 18 which is interconnected via drive shaft 17 to the motor 14.

Figure 2:
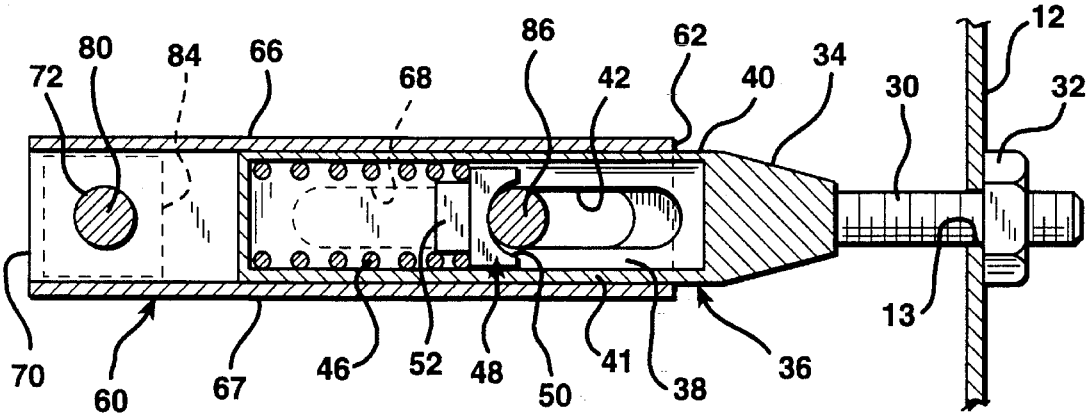
FIG. 2 is a partially-sectional side view of the tensioning apparatus shown in FIG. 1.

Referring to FIGS. 1 and 2, the elements of the chain saw tensioner of the present invention are shown in an exploded and side view respectively. The tensioner includes a tensioning screw 30 that extends through an aperture 13 in the housing 12 and is adjustable therewith. Tensioning screw nut 32 threads the tensioning screw and contacts the exterior of housing 10 to draw or back-off the tensioning screw 30 with respect to the housing 12. The tensioning screw 30 is interconnected with tensioning shank 34 which in turn is interconnected with tensioning shaft, generally indicated at 36.

Tensioning shaft 36 is of a hollow box construction and it includes tensioning shaft sides 38, tensioning shaft top 40, tensioning shaft bottom 41, and tensioning shaft slots 42 formed in the tensioning shaft sides 38. Tensioning shaft slots 42 extend along the tensioning shaft sides 38 in facing relation. The tensioning shaft 36 also includes a tensioning shaft end 44.

The tensioning shaft 36 is adapted to receive within the hollow interior thereof spring 46. Interconnected with spring 46 is bolt rest 48, which includes an arch 50 for receiving and supporting a bolt at a forward end and a spring engager 52 at a rearward end thereof for engaging the spring.

The tensioning shaft 36 is sized to be received by a tensioning sheath, generally indicated at 60. The tensioning sheath is also of a hollow box construction having an open end side walls 64, top and bottom walls 66 and 67 respectively, and an end wall 70. Formed in the side walls 64 are slots 68 positioned in a facing relation. The slots 68 are positioned to cooperate with the tensioning shaft slots 42 on the tensioning shaft 36. The tensioning sheath 60 also includes sheath anchor apertures 72 extending through the side walls 64 in facing relation for receiving anchor bolt 80 to fix the position of the sheath 60 with respect to the housing 12 of the chain saw 10 as will be hereinafter described.

The tensioner of the present invention includes an anchor bolt 80 and a sliding bolt 86. Anchor bolt 80 includes an anchor bolt nut 82 which is threadably engagable with the threaded end of anchor bolt 80. Additionally, anchor bolt 80 has an anchor bolt head 84. The sliding bolt 86 has a sliding bolt nut 88 and a sliding bolt head 90.

The heads 84 and 90 of the anchor bolt 80 and the sliding bolt 86 are sized to be received within a guide channel, generally indicated at 92. The guide channel 92 includes a side wall 94, a top 96, and a bottom 97. The side wall 94 includes a slot 98 extending therealong, which slot 98 is designed and positioned to cooperate with the slots 68 and 42 on the tensioning sheath 60 and the tensioning shaft 36, respectively. Additionally, the side 94 of the guide channel 92 includes an anchor aperture 99 which receives anchor bolt 80 and cooperates with the sheath anchor apertures 72 in the tensioning sheath 60 to anchor the end of the tensioning sheath with respect to the housing 12 as hereinafter described.

The heads 84 and 90 of the anchor and sliding bolts 80 and 86, respectively, are received within the guide channel 92. The anchor bolt 80 extends through the anchor aperture 99 of the channel 92 and then through the sheath anchor apertures 72 of the sheath to secure the tensioning sheath 60 to the anchor bolt 80.

The sliding bolt 86 extends through slot 98 in guide channel 92 and then extends into the tensioning sheath 60 through slot 68 and, accordingly, through the matching slots 42 in tensioning shaft 38, which shaft 38 is positioned within the tensioning sheath 60. Finally, the sliding bolt 86 extends through the slot 68 far side 64 of the tensioning sheath 60 to secure the sliding bolt 86 within the slots 98, 68 and 42.

As shown in FIG. 2, the sliding bolt 86 is supported in a horizontal dissection by the various slots through which it extends and is received and supported by bolt rest 48 positioned within the tensioning shaft 36. The bolt rest 48 includes the arch 50 which is sized and shaped to receive the sliding bolt 86. The bolt rest 48 is interconnected with the spring 46 by a spring engager 52 formed at the end of the bolt rest on the opposite side from the arch 50. The bolt rest 48 is biased to a forward position by the spring 46 and the bolt rest 48 bears against the sliding bolt 86 and translates the forward bias of the tension spring 46 to the sliding bolt 86 to slide it to a forward position.

Additionally, FIG. 2 shows the tensioning screw 30 extending through aperture 13 in housing 12. The screw nut 32 can be adjusted to draw or back-off the tensioning screw 30 with respect to the housing 12 to thereby vary the position of the tensioning shaft 36. By varying the position of the tensioning shaft 36, the slots 42 are moved forward or rearward with respect to the slots 68 in the tensioning sheath 60. This acts to draw or back-off the sliding bolt 86 in the direction of the tensioning screw 30 with respect to the anchor bolt 80.

Figure 3:
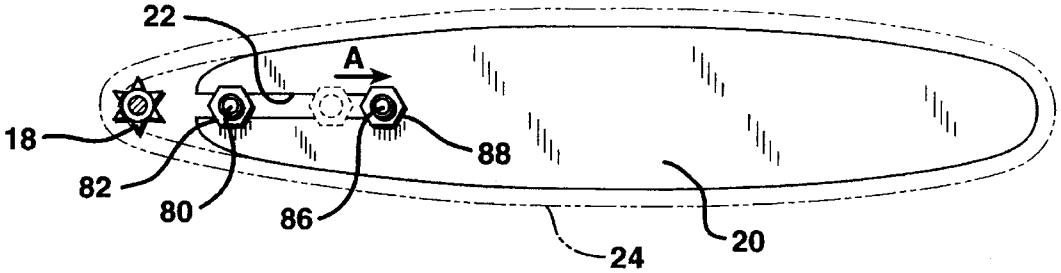
FIG. 3 is a side plan view of a chain saw blade and chain.

Referring now to FIG. 3, showing a chain saw blade 20, and a chain 24, it can be seen that the chain 24 rides around drive gear 18 and blade 20. Additionally, it can be seen that anchor bolt 80 extends through the slot 22 in saw blade 20 and secures the blade 20 thereto by anchor bolt nut 82. Likewise, it can be seen that sliding bolt 86 extends into the slot 22 of the blade 20 and is connected thereto by sliding bolt nut 88. Additionally, it is to be seen that the sliding bolt 86 can be moved in the direction shown by arrow A to move the saw blade 20 in the direction of arrow A to thereby increase the tension of the chain 24 around the saw blade 20. Likewise, movement of the sliding bolt 86 in the opposite direction moves the saw blade 20 in the opposite direction to decrease tension on the chain 24.

Figure 4:
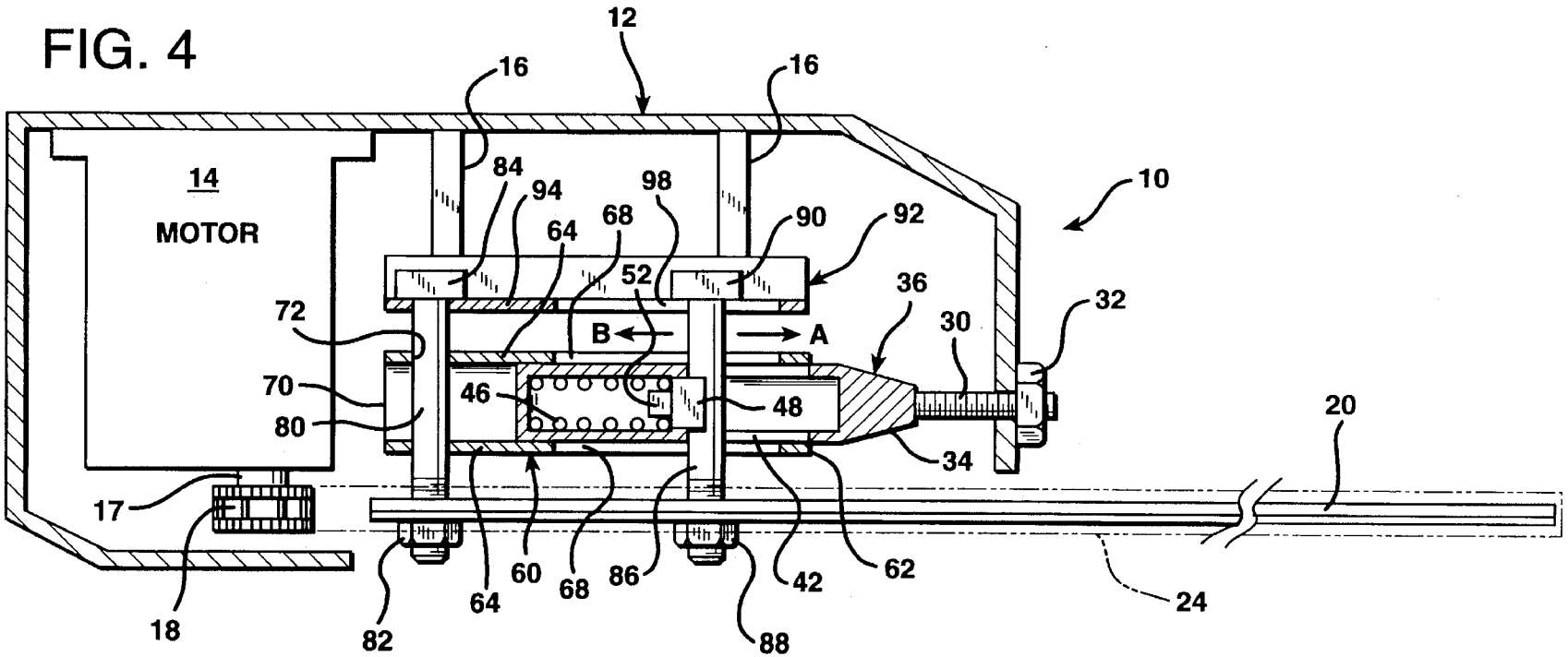
FIG. 4 is a top, partially-sectional view of a chain saw including the chain saw tensioner of the present invention.

Referring now to FIG. 4, showing the tensioner of the present invention in place in a schematic drawing of a chain saw 10, it can be seen that the guide channel 92 is interconnected with the housing 12 of the chain saw by tensioner mount beams 16. Additionally, it can be seen that the anchor bolt 80 extends from the guide channel 92 through the tensioning sheath 60 through the saw blade 20 where nut 82 is threaded thereon. Also, it can be seen that the sliding bolt 86 extends from the guide channel 92 through slot 98 and then through tensioning sheath 60 through slots 68 and through tensioning shaft 36 through slots 42 and then on through blade 20 where nut 88 is threaded thereon.

As can also be seen in FIG. 4, the tensioning shaft 36 is interconnected with the housing 12 by tensioning screw 30 and is locked or retained in position by tensioning nut 32. During operation, to tension the chain 24, the tensioning screw 30 is drawn through the housing 32 by actuating the tensioning nut 32. This draws forward the tensioning shaft 36. The rearward edge of the slots 42 in the tensioning shaft 36 draw the sliding bolt 86 forward with respect to the anchor bolt 80. This in turn, as shown in FIG. 3, draws the saw blade 20 forward in the direction of arrow A to tension the chain 24.

The spring 46 within the tensioning shaft 36 bears against the bolt rest 48 which engages the sliding bolt 86 to urges it forward in the direction of arrow A. This moves the slidable bolt 86 forward of the rearward edge of slots 42 in tensioning shaft 36. This permits movement of the adjustable bolt in the direction of arrow B to prevent overtensioning of the chain 24 and acts as a shock absorber to permit some movement of the blade 20 in the direction of arrow B. The movement permitted by spring 46 serves to prevent over-tensioning of the blade and the problems associated with such over-tensioning, for example, snapping or breaking the chain.

The slots 68 in tensioning sheath 60 coact with the slots 42 in the tensioning shaft 36 to limit the forward and rearward movement of the sliding bolt 86 and hence the blade 20 to operate the chain saw within a predetermined safe working parameters. Likewise, the slot 98 in the tensioner channel 92 corresponds in size to the slots 68 and are aligned therewith to reinforce the restrictions on the movements of the sliding bolt 86 and hence, the adjustability of the tension of the chain. Bolt 80 limits rearward movement of tensioning shaft 36.

Modifications of the foregoing may be made without departing from the spirit and scope of the invention. What is desired to be protected by Letters Patents is set forth in the appended claims.

What is claimed is:

1. An apparatus for tensioning a chain of a chain saw comprising:

tensioner mounts for mounting the apparatus within a housing of the chain saw;

tensioning guide means interconnected with the tensioner mounts, the tensioner guide means comprising:

a tensioner guide channel having a side;

a slot extending along the side;

an aperture in the side positioned rearward of the slot;

a tensioner box means interconnected with the tensioning guide means, the tensioner box means comprising:

opposing sides with slots in registration with the slot in the tensioning guide means;

an aperture extending through the opposing sides in registration with the aperture in the tensioning guide means;

tensioner shaft means telescopically received by the tensioner box means, the tensioner shaft means comprising sides with slots corresponding to the slots in the tensioner box means and the tensioning guide means;

a tension screw interconnected with the tensioner shaft means by a tensioner shank, at one end, the tension screw adjustably interconnected with the housing of the chain saw at the other end thereof;

a tensioner nut for adjustably engaging the tension screw with the housing of the chain saw;

a spring within the tensioner shaft means;

a bolt grip within the tensioner shaft means, the bolt grip interconnected with the spring and biased forward with respect thereto;

an anchor bolt extending through the tensioning guide means, the tensioner box means and a slot in a chain saw blade;

a slidable bolt extending through the slot in the tensioning guide means, the slot in the tensioner box means, the slot in the tensioner shaft means, and an aperture in a chain saw blade;

the bolt grip contacting the slidable bolt and acting against the slidable bolt to bias the bolt forward with respect to the housing of the chain saw, to bias the blade of the chain saw forward with respect to the housing, to tension the chain riding the chain saw blade.

2. The apparatus of claim 1 wherein the spring permits movement of the slidable bolt forward or rearward of the chain saw to tension and detension the chain riding the chain saw blade.

3. An apparatus for tensioning a chain of a chain saw comprising:

tensioning guide means interconnected with a housing of the chain saw;

tensioner box means interconnected with the tensioning guide means by anchor bolt means and sliding bolt means;

said guide means blade having a slot, and an aperture, the guide means interconnected with the tensioner box means by the anchor bolt means extending through the slot and the sliding bolt means extending through the aperture;

tension shaft means telescopically received by the tensioner box means, the tension shaft means interconnected with the housing of the chain saw by a tension screw extending from one end of the tension shaft means, the tension shaft means interconnected with the tensioning guide means and the tensioner box means by the sliding bolt means; and a tension spring within the tension shaft means for engaging the sliding bolt means.

4. The apparatus of claim 3 wherein the tensioning guide means, the tensioner box means and the tension shaft shaft have slots formed therein for limiting movement of the sliding bolt means.

5. The apparatus of claim 4 wherein the spring is interconnected with a bolt rest for receiving the sliding bolt means.

6. The apparatus of claim 5 further including a tension screw nut threadably engagable with the tension screw, the tension screw nut bearing against an outer wall of the housing of the chain saw for adjustably positioning the tension shaft means.

7. The apparatus of claim 4 wherein the slots in the tensioning guide means and the tensioner box means are in registration.

8. An apparatus for tensioning a chain of a chain saw comprising:

a tensioner shaft having slots extending along sides thereof and a tensioner screw extending from an end thereof;

a tensioner box telescopically receiving the tensioner shaft, the tensioner box having slots extending along sides thereof corresponding to the slots in the tensioner shaft;

a tensioning guide interconnected with the tensioner box, the tensioning guide having a slot extending along a side thereof;

a slidable bolt extending the slots in the tensioning guide, the tensioner box and the tensioner shaft.

9. The apparatus of claim 8 wherein the tensioner shaft includes a spring therein, the spring interconnected with the slidable bolt to bias the slidable bolt to tension the chain extending about a blade of the chain saw.

10. The apparatus of claim 9 wherein the spring is interconnected with a bolt rest for receiving the slidable bolt.

11. The apparatus of claim 10 further including a tension screw nut threadably engagable with a tension screw, the tension screw nut bearing against an outer wall of a housing of the chain saw for adjustably positioning the tensioner shaft.

12. The apparatus of claim 11 wherein the slots in the tensioning guide and the tensioner box are in registration.

* * * * *